US007273010B2

(12) United States Patent
Bissig

(10) Patent No.: US 7,273,010 B2
(45) Date of Patent: Sep. 25, 2007

(54) IMPACT PART OF A PROJECTILE

(75) Inventor: Josef Bissig, Altdorf (CH)

(73) Assignee: Saab Bofors Dynamics Switzerland Ltd., Thun (CH)

( * ) Notice: Subject to any disclaimer, the term of this patent is extended or adjusted under 35 U.S.C. 154(b) by 0 days.

(21) Appl. No.: 11/418,913

(22) Filed: May 5, 2006

(65) Prior Publication Data

US 2007/0028792 A1 Feb. 8, 2007

Related U.S. Application Data

(63) Continuation of application No. PCT/CH2004/000662, filed on Nov. 3, 2004.

(51) Int. Cl.
*F42C 1/00* (2006.01)
*F42B 12/10* (2006.01)

(52) U.S. Cl. ..... 102/398; 102/476; 102/273

(58) Field of Classification Search ..... 102/473, 102/475, 476, 501, 506, 398, 272, 273
See application file for complete search history.

(56) References Cited

U.S. PATENT DOCUMENTS

| | | | | |
|---|---|---|---|---|
| 43,835 | A * | 8/1864 | Converse | 102/517 |
| 803,519 | A * | 10/1905 | Anderson | 102/398 |
| RE13,132 | E * | 7/1910 | Gathmann | 102/519 |
| 2,342,006 | A * | 2/1944 | Moore | 102/519 |
| 3,002,453 | A * | 10/1961 | Fedor et al. | 102/382 |
| 3,105,440 | A * | 10/1963 | Denoix | 102/476 |
| 4,405,100 | A | 9/1983 | Daniels | |
| 5,259,319 | A * | 11/1993 | Dravecky et al. | 102/447 |
| 6,105,504 | A | 8/2000 | Ayres et al. | |
| 6,640,722 | B2 | 11/2003 | Stagrmuller | |
| 6,834,592 | B2 * | 12/2004 | Koger | 102/439 |

FOREIGN PATENT DOCUMENTS

| | | |
|---|---|---|
| BE | 530433 | 1/1955 |
| EP | 0 595 173 A1 | 5/1994 |
| WO | WO 2005/045356 A1 * | 5/2006 |

OTHER PUBLICATIONS

DERWENT Abstract of EP 595173 A1, Gottfried, K. May 1994.*

* cited by examiner

*Primary Examiner*—James S. Bergin
(74) *Attorney, Agent, or Firm*—Schweitzer Cornman Gross & Bondell LLP

(57) ABSTRACT

An impact part on a projectile permits the activation of detonation systems within a large angular range of contact with a target. The impact part is provided with annular recesses with embedded circular rings that engage with the target and prevent the projectile from rebounding. A thin-walled, dome-shaped tip prevents relatively large disruptive effects upon the projectile's hollow charge. As a result of dimensioning the impact part in accordance with the rules of fracture mechanics, it is possible to achieve a desired fragmentation on the target.

8 Claims, 2 Drawing Sheets

IMPACT PART OF A PROJECTILE

This application is a Continuation of application PCT/CH2004/000662 of Nov. 3, 2004.

The invention relates to an impact part on a projectile which contains at least one respective active charge and one detonation device activated upon impact, the impact part being constructed in the form of a bossed cap, with a cavity bounded thereby.

BACKGROUND OF THE INVENTION

Detonation devices, as are used for example in tandem hollow charges, require a defined impact shock for activation (cf. Data sheet PEPZ-05 Piezo Fuze System, PEPZ-05, Zaugg Elektronik AG, CH-4573 Lohn-Ammannsegg). It is therefore known to make the tips of projectiles of this type solid to a greater or lesser degree in the form of a bossed cap in order to transmit the necessary activation energy to the detonation device contained in the projectile. Attempts have also been made to activate the detonation chain by a bossed (rounded) shape of the tip upon oblique impact of the projectile on the target.

In practice, however, duds frequently occur, i.e., the projectile is deflected by the target and/or the impact energy absorbed is not sufficient to activate the detonation chain. This problem occurs to an increased degree in the case of tandem hollow charges and multiple warheads which have stand-alone detonation devices independent of one another and in which each detonation device has a separate safety characteristic.

A projectile with at least one active charge and with an impact part is known from EP-A1-595 173, in which its stable jacket is coated with a rubber-like layer. In this way a so-called "eraser effect" is achieved in the case of flat angles of impact at the target, i.e. the projectile is braked in order to cause the active charge to detonate on the spot. Grooves and the like are provided inter alia in order to anchor the layer in an effective, positively locking manner, so that the desired delay occurs at the target even in the case of flat angles of impact.

Hard faces, for example armour plating covered with ceramic plates, cannot be successfully penetrated with this solution. The jet of material formed cannot penetrate the armour plating with a hollow charge which strikes the target at a flat angle; although it is triggered at the correct time, it is then deflected together with the impact part.

In order to prevent the projectile head from rebounding and slipping off, an anti-tank projectile as described in BE-A-530 433 has at least one toothed ring which is mounted on a double hood of the projectile head. The toothed ring consists of a very hard material and therefore suitable for engaging steel plates.

A mounted toothed ring is not suitable against modern armour plating with a plurality of external ceramic plates. The ring either escapes out of its anchoring and/or breaks into pieces. Individual plates or a plurality of plates can likewise spring off, so that the projectile thus slips off before it can deploy its only active charge. Another drawback of such a projectile is its aerodynamically disadvantageous shape which leads to an unstable trajectory of the projectile at high speeds. In addition, the shock wave required for the activation of the detonation generator cannot spread in a desired manner over the jacket of the projectile, so it is not possible to use such a construction for a multiple charge warhead.

The object of the present invention is therefore to provide an impact part which produces the necessary energy required for initiating a detonation even in the case of projectiles which strike the target at an oblique angle of impact.

BRIEF DESCRIPTION OF THE INVENTION

In accordance with the present invention, an impact part is provided that is suitable for projectiles with hollow charges and retains the firing direction even on hard faces and with a relatively flat angle of impact so that the jet of the hollow charge penetrates the target.

The impact part likewise does not adversely affect following jets of the hollow charge and is able to carry out an effective operation even in the case of active armour plating, (such as explosive reactive armour or ERA). The aerodynamics of the projectile is not adversely affected as a result; and the external ballistics are likewise not altered with respect to other similar projectiles.

The foregoing benefits are obtained by the present invention, comprising a projectile impact part constructed in the form of a bossed cap in which the tip is thin-walled relative to its lateral walls. Annular grooves are let into the lateral walls, the grooves having sharp edges and are filled with elastomer.

Annular grooves engage the target, even if they strike it obliquely, and they trigger the detonation process. Because of the embedded elastomer the air-resistance characteristics with respect to smooth impact parts are retained. In a normal case (striking the target at an oblique angle) the thin-walled tip does not adversely affect the performance of the projectile.

As a result of deploying sharp edges arranged in succession, the impact part engages the target or cuts into the surface thereof, so that the projectile is not deflected and remains on the target.

Tandem hollow charges striking the target at an angle of from 20° to 60° are preferred. It has been found that during the transmission of the energy required for detonating the charges the tip is damaged in this angular area in such a way that the hollow-charge jet of the preliminary charge still has sufficient energy to detonate an ERA box (i.e. the explosive forced into the target). On account of the flat design of the explosive forced in, external metallic protective plates of the armour plating of the target are blasted off at a right angle to their base and fly past the projectile, so that the hollow-charge jet of the main charge can now exert its full effect.

The tip can be designed in such a way that, when the projectile strikes the target face more or less at a right angle, the tip absorbs the energy of the first hollow-charge jet (the preliminary charge) and disrupts its build-up to the extent that an ERA box is not detonated. The second, stronger jet of the main charge which has been already completely formed then penetrates through the tip which has already been bored through, detonates the ERA box, penetrates the target's metallic covering and can expand into the target's armour plating. In such a case the effect of the projectile corresponds to that of a simple hollow charge detonated in an optimum state.

The invention capitalizes upon the phenomenon that the same impact part allows the jet of the preliminary charge to become effective if it strikes the target at an oblique angle and does not if it strikes the target more or less at a right angle. This can be explained by the fact that if the dome of the tip strikes at a right angle—before it shatters—it is turned inside out and, as a result, disrupts on a massive scale the hollow-charge jet which is still building up. In this way, the energy of the jet is not sufficient to activate the ERA box.

This effect can be achieved if the impact part consists of a sufficiently tough but nevertheless still ductile steel. Untempered heat-treatable steels have proved successful for this purpose.

Annular seals formed by the elastomer are particularly simple to manipulate. They can easily be inserted and they protect the personnel handling the projectile from injuries. Upon impact with the target the annular seals are pushed away and release the sharp edges for engagement. Such seals in the form of commercially available O-rings are particularly economical and resistant in a wide temperature range and are not subject to wear during normal handling.

Construction of the internal part of the impact part with profile discontinuities allow breaking locations to be pre-set in accordance with breaking mechanics. Further breaking locations can be defined with the inclusion of notch factors, so that for example a desired fragmentation of the impact part takes place and, as a result, the subsequent hollow-charge jet can build up without obstruction.

The assembly of the projectile is facilitated by the provision of an external thread. In addition, impact parts with differing breaking characteristics can be prepared and can be adapted to the intended target.

The geometrical adaptation of the external shape to form an angle of between 15 and 90 degrees between a line of contact on the target and the flight direction's axis can allow a minimum angle of impact required to initiate detonation to be determined.

42 CrMo 4 V (in accordance with DIN [German Industrial Standard] 1.72225) has proved highly successful as a heat-treatable steel on account of its high degree of toughness.

BRIEF DESCRIPTION OF THE DRAWINGS

Preferred but illustrative embodiments of the invention are presented with reference to the annexed drawings, wherein.

DETAILED DESCRIPTION OF THE EMBODIMENTS

Figure 1:
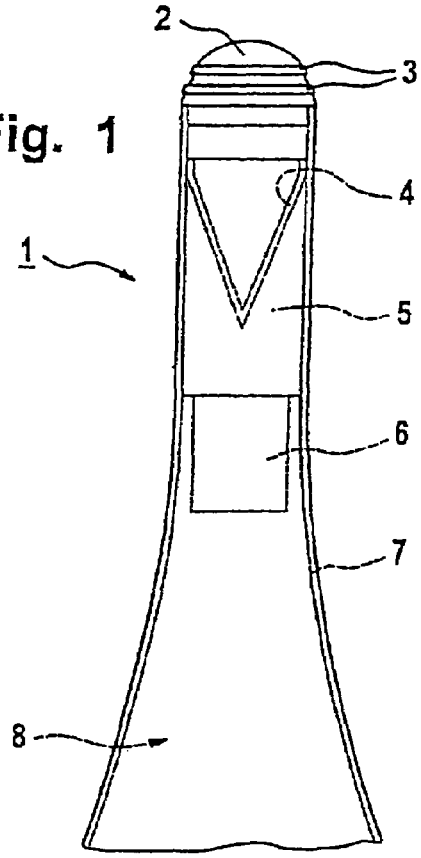
FIG. 1 is a diametric sectional view of a projectile head with an impact tip, a preliminary charge and a detonation system in accordance with the invention.

A head of a projectile of a tandem hollow charge is designated 1 in FIG. 1. An impact part comprises a tip 2 in the shape of a dome with embedded elastomers, i.e. with O-rings 3 of silicone rubber, and it is set up on a preliminary charge with a covering 4, an explosive 5 and a detonation device 6. The projectile envelope 7 enclosing the whole is of a slender configuration and has a known main charge (not shown) at the end of its cavity. Behind the explosive 5 and the detonation device 6 the projectile envelope 7 encloses a cavity 8 which forms the spacing distance required to the main charge.

Figure 2:
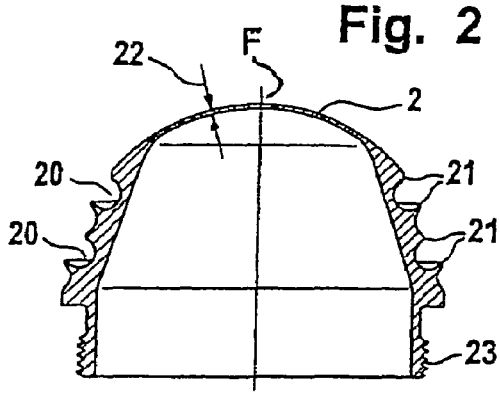
FIG. 2 is a sectional view of the main body of the impact tip of FIG. 1, shown enlarged.

The sectional illustration of FIG. 2 shows the profile of the impact part of FIG. 1. Annular grooves 20, which have sharp edges 21, are formed at right angles to the axis (flight direction) F. The tip 2, which is very thin-walled, and of lesser thickness 22 than the impact part's lateral walls of its thickness. In the impact part's lower region, i.e. at its rear, an external thread 23 is provided in the lateral walls which allows the impact part to be screwed into the front end of the projectile envelope 7. The shape and location of internal discontinuities, such as between the tip and the lateral walls and between the portion of the lateral walls bearing the grooves and the rearward end of the walls bearing the threads 23, can assist and control the fragmentation of the tip to avoid obstruction to the generated hollow-charge jet.

Figure 3:
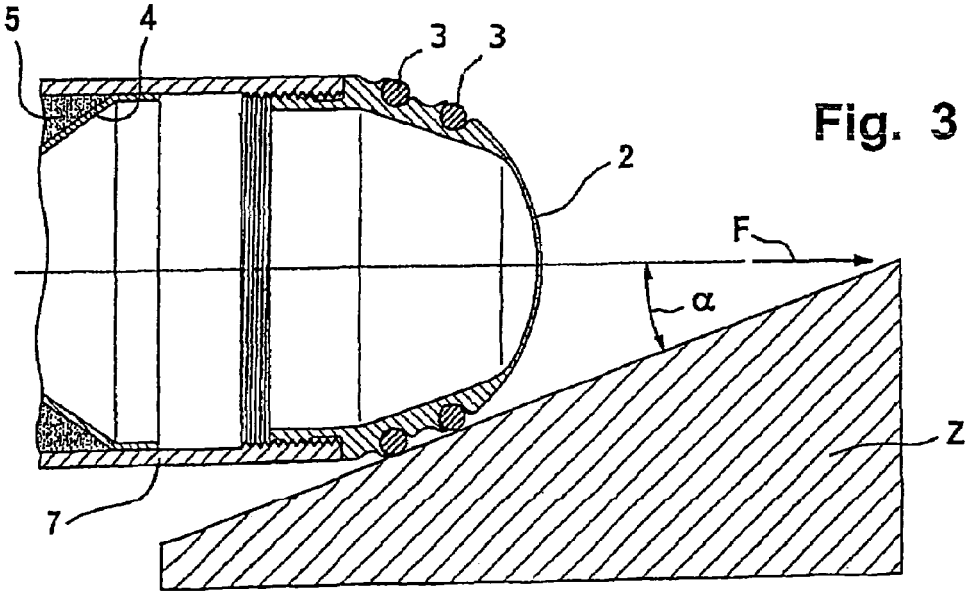
FIG. 3 is a representation of the projectile tip of FIG. 1 when striking an oblique-angled target face.

The illustration of FIG. 3 shows the front portion of the projectile on impact against a target Z at an oblique angle designated a with respect to the flight direction F.

In this case it is evident that the elastic rings 3 are pushed away by the target, so that the sharp edges 21, FIG. 2, hook into the surface of the target. As a result, the projectile is substantially prevented from rebounding; a sufficiently large impact shock is produced for initiating the detonation systems.

Figure 4:
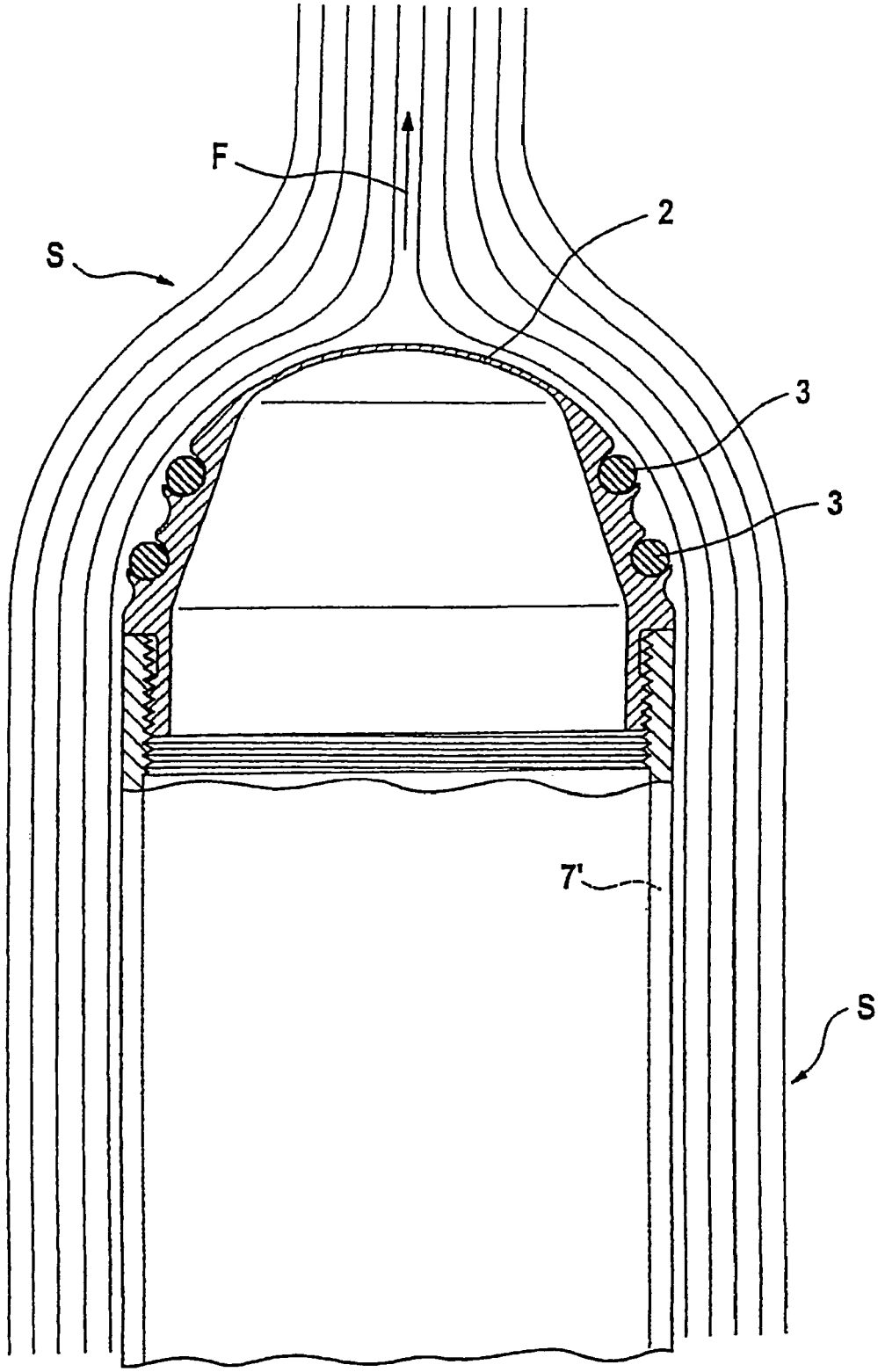
FIG. 4 is an illustration of the flow conditions on a large-calibre projectile body of the invention.

FIG. 4 shows, as an alternative, a head of a larger ammunition body, as desired per se, according to the invention with filaments of flow S indicated. The elastic rings 3 in the annular grooves prevent turbulence even at high firing speeds, while the contour of the tip combined with the threading 23 allow the tip to conform to the geometry of the projectile head.

The subject of the invention permits the optimum use of projectiles, in conventional impact parts. As a result, the proportion of duds is also significantly reduced.

I claim:

1. An impact part of a projectile which contains at least one active charge and one detonation device activated upon impact, the impact part being constructed in the form of a bossed cap having a tip and lateral walls with a cavity bounded thereby, characterized in that the tip is thin-walled relative to the lateral walls, at least two annular grooves concentric to a flight direction F extending along a main longitudinal axis of the projectile are let into externally facing sides of the lateral walls, the annular grooves having forwardly-directed sharp edges for target engagement, the annular grooves each having an elastomer embedded therein, the externally facing sides of the lateral walls being free of elastomer in areas separate from the annular grooves.

2. An impact part according to claim 1, characterized in that the embedded elastomers are in the form of annular seals.

3. An impact part according to claim 2, characterized in that the annular seals are O-rings of silicone rubber.

4. An impact part according to claim 1, characterized in that the internal shape of the impact part has in internal shape with a profile which displays discontinuities.

5. An impact part according to claim 1, 2 or 3, characterized in that the impact part has an external thread, the thread and an external shape of the impact part being adapted to a contour of a head of the projectile.

6. An impact part according to claim 1, characterized in that an external shape of the impact part and the grooves are selected to be such that a line of contact with a target forms an angle a of from 15° to 90° to the flight direction F.

7. An impact part according to claim 1, characterized in that the tip is dome-shaped and has a wall thickness and material selected such that the tip shatters at least in part upon impact with a hard target at an angle of from 80° to 90°.

8. An impact part according to claim 1, characterized in that it comprises an untempered heat-treatable steel.

* * * * *